US011339341B1

(12) United States Patent
McCarthy

(10) Patent No.: US 11,339,341 B1
(45) **Date of Patent: *May 24, 2022**

(54) BIOFUEL PRODUCT WITH FAT, OIL AND/OR GREASE COMPONENTS

(71) Applicant: Martin Franklin McCarthy, Charlotte, NC (US)

(72) Inventor: Martin Franklin McCarthy, Charlotte, NC (US)

(73) Assignee: Martin Franklin McCarthy, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/514,105

(22) Filed: Oct. 29, 2021

Related U.S. Application Data

(63) Continuation-in-part of application No. 17/362,168, filed on Jun. 29, 2021.

(60) Provisional application No. 63/164,761, filed on Mar. 23, 2021.

(51) Int. Cl.
*C10L 5/44* (2006.01)
*C10L 5/36* (2006.01)

(52) U.S. Cl.
CPC ..... *C10L 5/44* (2013.01); *C10L 5/368* (2013.01); *C10L 2200/0469* (2013.01); *C10L 2200/0484* (2013.01); *C10L 2230/02* (2013.01); *C10L 2270/08* (2013.01)

(58) Field of Classification Search
CPC .... C10L 5/44; C10L 5/368; C10L 2200/0469; C10L 2200/0484; C10L 2230/02; C10L 2270/08
See application file for complete search history.

(56) References Cited

U.S. PATENT DOCUMENTS 6,508,849 B1 * 1/2003 Comas ..... C10L 5/368 44/543
6,818,027 B2 * 11/2004 Murcia ..... C10L 5/44 44/550

(Continued)

FOREIGN PATENT DOCUMENTS

CA 2931443 A1 * 11/2017
DE 102009013985 A1 * 9/2010 ..... C10L 11/04

(Continued)

OTHER PUBLICATIONS

Olga et al., Cleanup of Water Surface from Oil Spills Using Natural Sorbent Materials, National Research Tomsk Polytechnic University, Procedia Chemistry 10 (2014), pp. 145-150.

(Continued)

*Primary Examiner* — Pamela H Weiss
(74) *Attorney, Agent, or Firm* — Shumaker, Loop & Kendrick, LLP

(57) ABSTRACT

A biofuel product having constituents selected from the group including fat, oil and/or grease components. A container is formed of a biodegradable material having a multiplicity of openings of a size and shape adapted for allowing the fat, oil and/or grease components to pass through the openings to an interior area of the container. An absorbent capture material is positioned in the container and holds a quantity of the fat, oil and/or grease. The container, capture material and fat, oil and/or grease collectively comprise the biofuel product.

8 Claims, 3 Drawing Sheets

(56) References Cited

U.S. PATENT DOCUMENTS 7,354,516 B1 * 4/2008 Young ..... B09C 1/10 210/615
7,597,727 B1 * 10/2009 Morris ..... C10L 5/36 44/531
10,066,178 B2 * 9/2018 Tanel ..... C10L 5/368
2003/0079400 A1 * 5/2003 Weissman ..... C10L 5/368 44/541
2004/0035046 A1 * 2/2004 Weissman ..... C10L 11/06 44/519
2005/0268542 A1 * 12/2005 Weissman ..... C10L 5/368 44/541
2006/0000767 A1 * 1/2006 Trauger ..... B32B 5/26 210/503
2006/0156621 A1 * 7/2006 Kraus ..... A47J 37/0768 44/530
2006/0230673 A1 * 10/2006 Barford ..... C10L 5/365 44/535
2007/0169409 A1 * 7/2007 Chang ..... C10L 11/04 44/540
2012/0006761 A1 * 1/2012 Parker ..... B01D 39/02 210/483
2012/0251597 A1 * 10/2012 Gupta ..... D04H 1/56 5/413 R
2014/0087315 A1 * 3/2014 Doyle ..... C10L 5/368 431/267
2015/0322361 A1 * 11/2015 Creutzmann ..... C06F 5/00 44/507
2017/0081251 A1 * 3/2017 Townsend ..... A01K 1/0152
2017/0226440 A1 * 8/2017 Fandrich ..... C10L 5/368
2019/0040593 A1 * 2/2019 Tetrault ..... B32B 5/26
2021/0002571 A1 * 1/2021 Zeitler ..... C10L 5/363

FOREIGN PATENT DOCUMENTS

DE 102012104574 A1 * 12/2013 ..... C10L 11/04
DE 202014001312 U1 * 5/2014 ..... C10L 5/146
DE 202019003324 U1 * 10/2019
EP 2216387 A1 * 8/2010 ..... C10L 5/14
FR 2989384 A1 * 10/2013 ..... C10L 5/04
GB 2389858 B * 1/2005 ..... C10L 11/04
KR 1953361 B1 * 2/2019 ..... C10L 5/06
WO WO-2008141752 A1 * 11/2008 ..... A47J 37/079
WO WO-2012062324 A1 * 5/2012 ..... C10L 11/06
WO WO-2013108223 A1 * 7/2013 ..... C10L 5/04
WO WO-2019145944 A1 * 8/2019

OTHER PUBLICATIONS

City of Dothan Alabama, Fats, Oils, and Grease (FOG) Science, Dated Oct. 27, 2020, Retrieved from https:/www.dothan.org/DocumentCenterNiew/3032/FOG-Science?bidld, 7 Pages.

* cited by examiner

BIOFUEL PRODUCT WITH FAT, OIL AND/OR GREASE COMPONENTS

PRIORITY CLAIM

This continuation-in-part utility application claims priority from U.S. Utility patent application Ser. No. 17/362,168, filed Jun. 29, 2021, which claims priority from U.S. Provisional Patent Application Ser. No. 63/164,761, filed Mar. 23, 2021, the content of which is incorporated herein by reference.

TECHNICAL FIELD AND BACKGROUND OF THE INVENTION

The present invention relates to a biofuel product having fat, oil and/or grease components. In its preferred forms, the product is densely contained within a container that is itself combustible and therefore may comprise an integral part of the biofuel product.

The National Pretreatment Program implements Clean Water Act requirements to control pollutants that are introduced into publically-owned treatment works ("POTWs"). As part of this program, EPA has promulgated General Pretreatment Regulations that require the establishment of State and local pretreatment programs to control pollutants which pass through or interfere with POTW treatment processes or may contaminate POTW sewage sludge. Meeting these requirements may require elimination of interference caused by the discharge to POTWs of Fat, Oil, and Grease (FOG) from food service establishments (FSE). More specifically, the Pretreatment Program regulations at 40 CFR § 403.5(b)(3) prohibit "solid or viscous pollutants in amounts which will cause obstruction" in the POTW and its collection system. EPA's Report to Congress on combined sewer overflows (CSOs) and sanitary sewer overflows (SSOs) identified that "grease from restaurants, homes, and industrial sources are the most common cause (47%) of reported blockages. Grease is problematic because it solidifies, reduces conveyance capacity, and blocks flow."

Controlling FOG discharges will help POTWs prevent blockages that impact CSOs and SSOs, which cause public health and water quality problems.

FOG wastes are generated at food service establishments as byproducts from food preparation, and cleaning activities for pans, dishes, utensils and other surfaces. FOG captured on site is generally classified into two broad categories. The first type is yellow grease that is the byproduct of deep frying, and often captured in large containers, then ultimately sold into the reuse market. The second type of FOG, focus of this application, are the fat, oil and grease that are washed down the sink and floor drains into the Grease Trap. These fats, oils and grease are a result of cleaning pans, plates, utensils and other grease-laden surfaces in the food service establishment. The annual production of grease trap waste is massive. Currently the EPA estimates between 23,000 and 75,000 Sanitary Sewer Overflows per year. Food service establishments create volumes of FOG that run from 800 to 1,700 pounds per year. Furthermore one source indicates that Americans produce 13 pounds of F.O.G. per capita per year.

Food service establishments can adopt a variety of best management practices or install interceptor/collector devices to control and capture the FOG material before discharge to the POTW collection system. For example, instead of discharging yellow grease to POTWs, food service establishments often accumulate this material for pick up by consolidation service companies for re-sale or re-use in the manufacture of tallow, animal feed supplements, fuels, or other products.

Additionally, food service establishments can install interceptor/collector devices (e.g., grease traps) in order to accumulate FOG on-site and prevent it from entering the POTW collection system. In many cases, an establishment that implements best management practices will realize financial benefit through a reduction in their required grease interceptor and trap maintenance frequency.

Likewise, more and more POTWs are addressing FOG discharges by imposing mandatory measures of various types, including inspections, periodic grease pumping, stiff penalties, and even criminal citations for violators, along with 'strong waste' monthly surcharges added to restaurant sewer bills.

As a separate matter, large quantities of motor vehicle oils and lubricants also end up in water supplies for various reasons. Motor vehicle oils and lubricants thus fall within the definition of fats, oils and/or grease as used in this application.

Pretreatment programs are developing and using inspection checklists for both food service establishments and POTW pretreatment inspectors to control FOG discharges. Additionally, EPA identified typical numeric local limits controlling oil and grease in the range of 50 mg/L to 450 mg/L with 100 mg/L as the most commonly reported numeric pretreatment limit.

With this information in mind, it is apparent that while there has been some progress in collecting and disposing of FOG, much more needs to be done. In particular, there is a need for a biofuel product composed largely of FOG and similar natural, biodegradable materials having high energy density and usable as fuel in a wide variety of applications and at low cost.

Accordingly, the invention of this application employs a specially-designed container, such as but not limited to an absorbent tube or mat into which FOG can be introduced for collection, transport and consumed as a fuel product. In one example, an elongate tube or absorbent mat geotextile product is used to contain sphagnum peat or mushroom compost materials, and to maximize contact surface area with the FOG materials in, for example, a grease trap. The sphagnum peat or mushroom compost is obtained from select locations in the United States or Canada known for this type of specialized product. As used in this application, peat, mushroom and similar materials into which the FOG is absorbed are referred to generally and broadly as "capture materials."

Several products suitable for use in the FOG tube described in this application are "Dry All" wood fiber, sphagnum peat moss processed and sold by Integrity Absorbent Products, or shredded mushrooms. In particular, the peat moss product is an all organic hydrocarbon absorbent, manufactured from large fiber sphagnum peat moss. The manufacturing process produces a product which becomes both oleophilic, absorbing hydrocarbons and hydrophobic, i.e., repelling water. Due to its fibrous structure and processing, peat absorbs hydrocarbons quickly on contact by virtue of its wicking capillary action and encapsulates oil on contact. This makes peat ideal for hydrocarbon cleanup both on open water and land applications. Peat absorbs up to eight times its weight. This volume will vary based on the hydrocarbon being absorbed and the temperature.

This type of natural cleansing and separation is one of the unique features of this invention and why it will be useful to restaurants, industrial facilities and car repair shops that struggle with the maintenance of grease traps and oil spills. Once trapped in the tube or mat, the product can be easily and compactly shipped to a location for disposal, incineration or further processing, including processing the materials for use as fuel.

Sewage Sludge Incineration (SSI) is becoming a safe and effective alternative around densely populated municipalities where land application of sewage sludge is less desirable. One of the benefits of the sphagnum peat FOG absorbent tubes and mats is that they comprise a high BTU fuel that can be used to increase the efficiency of SSI processes. In addition to providing a better and more efficient way for collecting and disposal of FOG, the product can separate the higher density grease and oil so that it can be disposed of in a landfill, and/or burned as fuel in a sludge incinerator or other furnace.

SUMMARY OF THE INVENTION

Therefore, it is an object of the invention to provide a biofuel product having fat, oil and/or grease constituents.

It is another object of the invention to provide a biofuel product having fat, oil and/or grease constituents that provide enhanced environmental remediation by avoiding the need to dispose of the materials in landfills or other geographical locations.

It is another object of the invention to provide a product having fat, oil and/or grease constituents that provide for the ability to utilize natural, renewable, biodegradable materials to produce a fuel suitable for a wide variety of uses.

It is another object of the invention to provide having fat, oil and/or grease constituents that burned as fuel in a sludge incinerator or in other facilities such as furnaces.

It is another object of the invention to utilize containers, such as tubes, mats and other configurations to capture spills of oil and other hydrocarbons at vehicle repair facilities that can then be burned along with the oil or other hydrocarbons as fuel.

These and other objects and advantages are achieved by providing a biofuel product having constituents selected from the group consisting of fat, oil and/or grease components, a container formed of a biodegradable material having a multiplicity of openings of a size and shape adapted for allowing the fat, oil and/or grease components to pass through the openings to an interior area of the container, an absorbent capture material positioned in the container and holding a quantity of the fat, oil and/or grease, the container, capture material and fat, oil and/or grease collectively comprising the biofuel product.

According to another aspect of the invention, the container is a biodegradable geotextile.

According to another aspect of the invention, the container is constructed of a biodegradable yarn selected from the group consisting of cotton, hemp, ramie and jute.

According to another aspect of the invention, the openings in the container have an apparent opening size (AOS) of 0.25 mm to 0.5 mm.

According to another aspect of the invention, the container is a tube.

According to another aspect of the invention, the container is a three-dimensional box-like mat.

According to another aspect of the invention, the fat, oil and/or grease absorbent capture material is selected from the group consisting of sphagnum peat and mushroom compost.

According to another aspect of the invention, the fat, oil and/or grease is present in a range of between 88-75 percent and the capture material is present in a range of between 12 and 25 percent.

According to another aspect of the invention, the fat, oil and/or grease and the absorbent capture material is processed according to a process selected from the group of processes consisting of compressing the fat, oil and/or grease and the absorbent capture material into pellets, logs, cakes, shredding and granulating.

According to another aspect of the invention, the fat, oil and/or grease, the absorbent capture material and the container collectively comprise the biofuel product.

According to another aspect of the invention, the biofuel product contains between 88-75 percent FOG and between 12 and 25 percent capture material.

According to another aspect of the invention, the range of B.T.U. output of the biofuel product is 12,500 to 20,000 B.T.U. per pound.

According to another aspect of the invention, a biofuel product is provided having constituents selected from the group consisting of fat, oil and grease components, and including a container formed of a biodegradable geotextile having a multiplicity of openings have an apparent opening size (AOS) of 0.25 mm to 0.5 mm and adapted for allowing the fat, oil and/or grease components to pass through the openings to an interior area of the container. An absorbent capture material is positioned in the container and holds a quantity of the fat, oil and/or grease, the container, capture material and fat, oil and/or grease collectively comprising the biofuel product. The fat, oil and/or grease absorbent capture material is selected from the group consisting of sphagnum peat and mushroom compost. The fat, oil and/or grease present in a range of between 88-75 percent and the capture material present in a range of between 12 and 25 percent. The fat, oil and/or grease and the absorbent capture material can be presented in a multiplicity of forms including pellets, cakes, logs, or as shredded or granulated fuel.

According to another aspect of the invention, the container includes a tether for positioning the container at an influent end of a source of fat, oil and/or grease during absorption of the fat, oil or grease into the capture material.

According to another aspect of the invention, the fat, oil and/or grease is present in a range of between 88-75 percent and the capture material present in a range of between 12 and 25 percent, the fat, oil and/or grease and the absorbent capture material being in a multiple of forms including pellets, cakes, logs, or as shredded or granulated fuel and the range of B.T.U. output of the biofuel product is 12,500 to 20,000 B.T.U. per pound.

According to another aspect of the invention, the container includes one closed end and an open end adapted for being closed after being filled with the capture material.

DETAILED DESCRIPTION OF THE PREFERRED EMBODIMENTS

Figure 1:
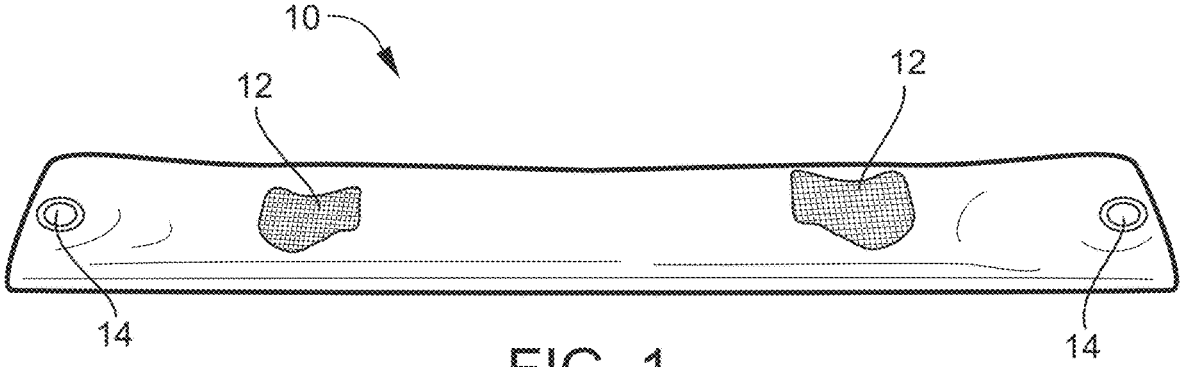
FIG. 1 is a perspective view of the geotextile container in tube form according to an embodiment of the invention.
Figure 2:
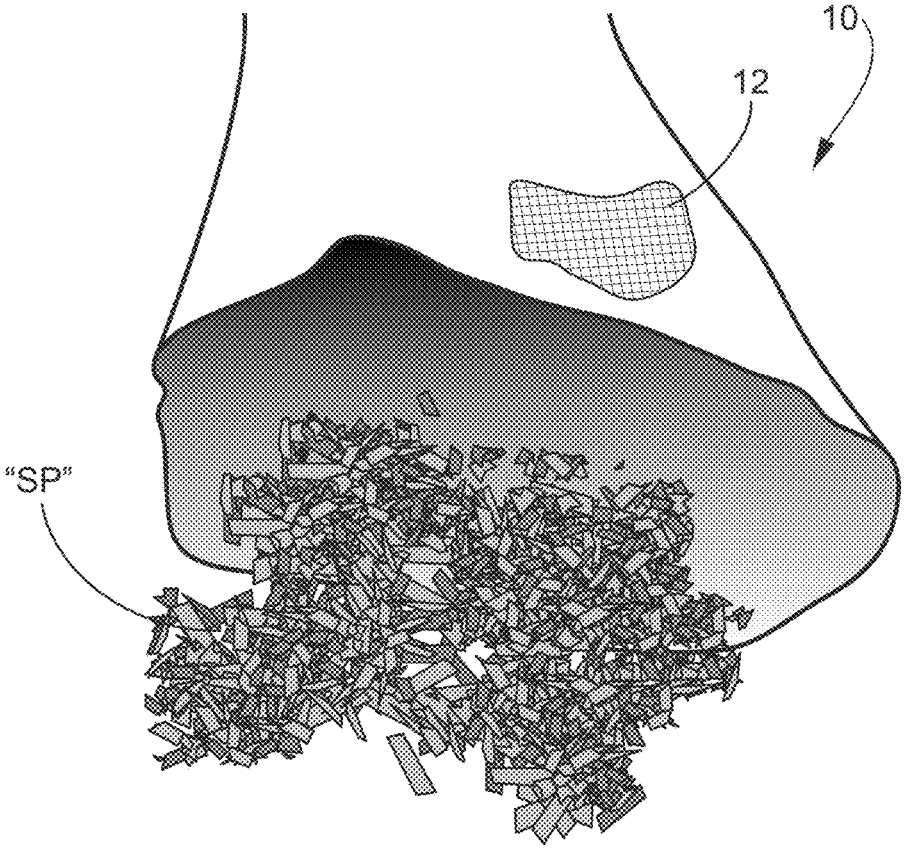
FIG. 2 is a fragmentary, enlarged end view of the tube of FIG. 1, shown in an open positon for receiving a quantity of sphagnum peat material or other absorbent material.

Referring now to the drawings, a container in the form of a tube 10 for use in the present invention is shown in the FIGS. 1-2, as noted. The tube 10 may be constructed according to many suitable constructions, but one construction comprises an elongate tube 10 that is formed of a geotextile fabric 12 that may be constructed by circular knitting, flat knitting, weaving, non-woven formation or any other fabric construction having a multitude of openings through the thickness of the fabric 12. The fabric 12 is preferably seamed along its length or circular knitted to form the tube 10. The tube 10 is preferably constructed of a biodegradable or natural material that will combust with minimal residue. The fabric 12 of the tube 10 may be constructed of any suitable natural or biodegradable yarn, for example, with a natural fiber such as cotton, hemp, ramie, jute or similar material because of its biodegradable characteristics, with apparent opening size (AOS) on the order of 0.25 to 0.5 mm depending on the size of the sphagnum peat or mushroom compost absorbent material. The empty tube 10 may be any suitable length and diameter, for example, 60 cm to 120 cm long and 7 cm to 15 cm in diameter depending on the size of the grease trap and the FOG loading from the restaurant or vehicle repair facility. As manufactured, the tube 10 is preferably closed at one end and filled from the opposite, open end. The open end of the filled tube 10 may be closed with any suitable closure, such as stitching, clips or tied off with cord at the top of the grease trap or other FOG separating and collection structure.

Figure 5:
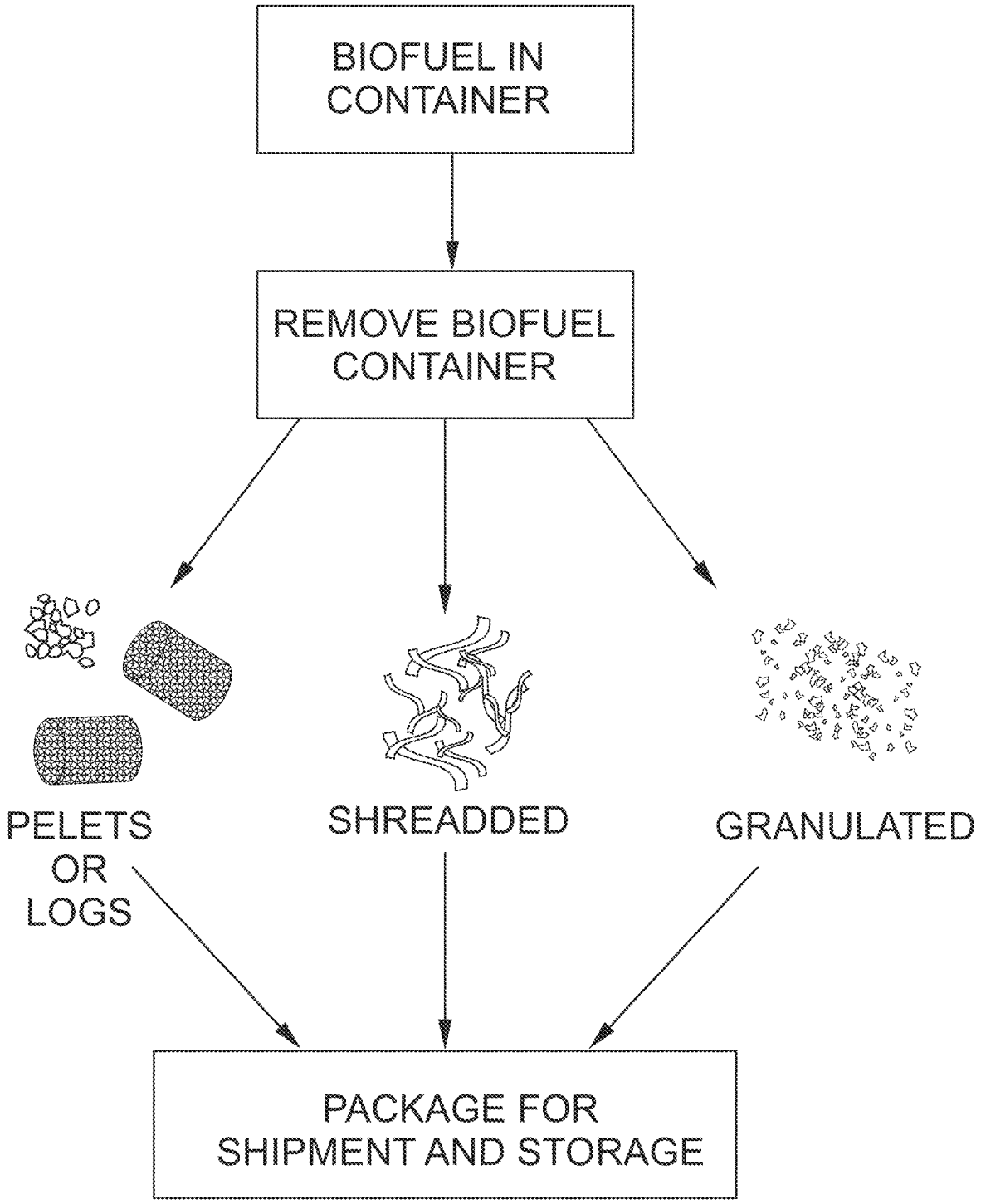
FIG. 5 schematically illustrates the processes by which the biofuel is processed into various end use configurations.

The tube 10 may include an opening 14 on either or both ends to receive a cord 16, as shown in FIG. 5, by which the tube 10 may be lowered into and retrieved from a grease trap or other enclosure and tethered to the grease trap or other structure while in use.

One or more coatings may be applied to the fabric 12 to prevent penetration of the fabric 12 surface by water or aqueous salts thereby allowing the fabric 12 substrate to be non-absorbent for water or soluble salts.

Figure 3:
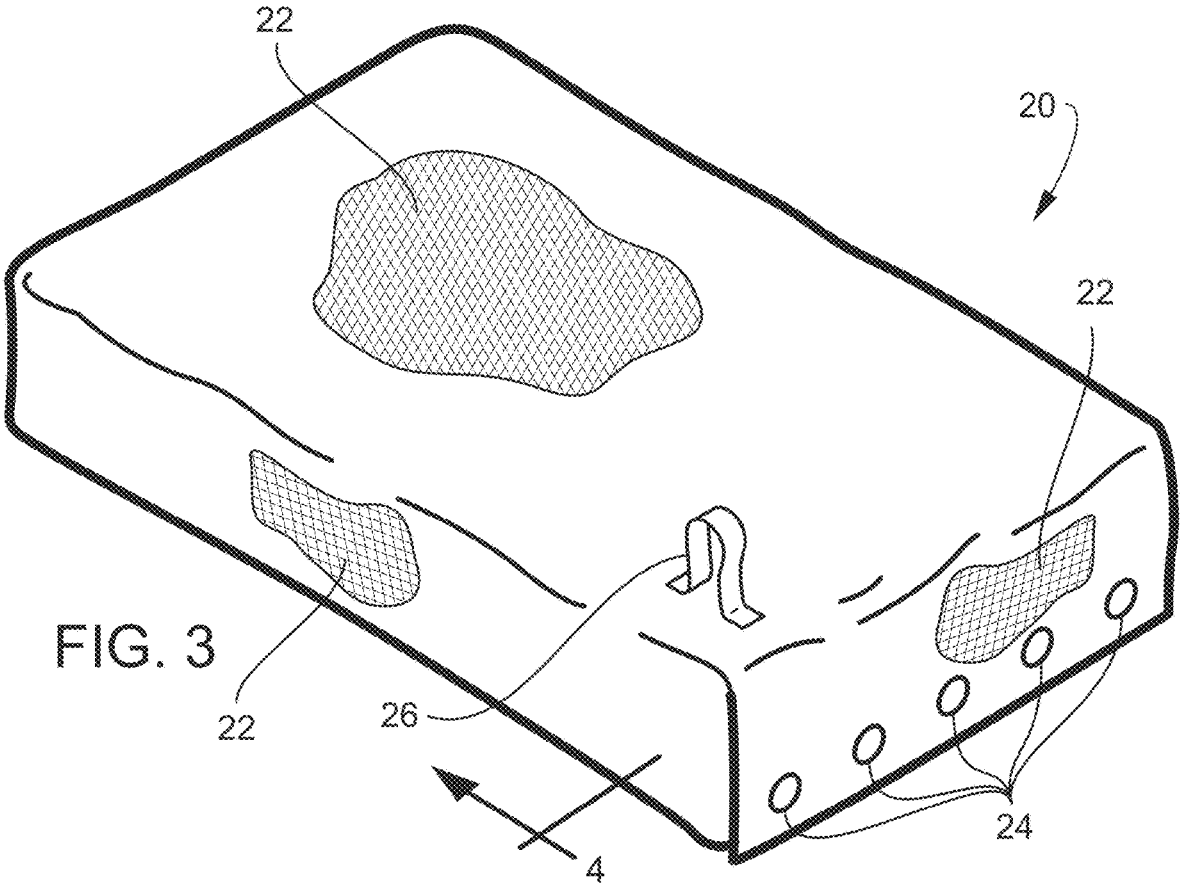
FIG. 3 is a perspective view of a geotextile container in mat form according to an embodiment of the invention.
Figure 4:
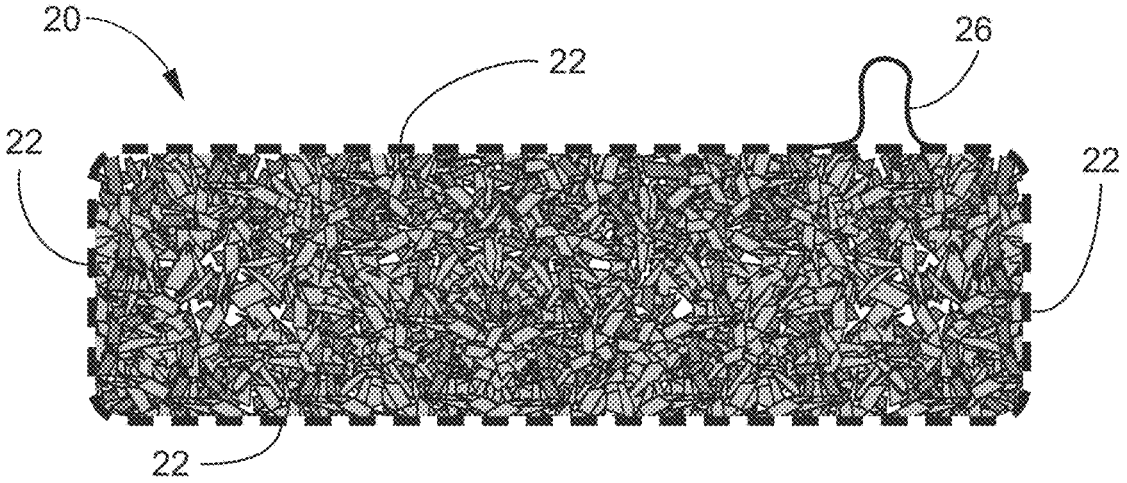
FIG. 4 is a vertical cross-section of the geotextile mat with sphagnum peat material or other absorbent material contained in the mat.

Referring now to FIGS. 3 and 4, a container in the form of a mat 20 for use in the present invention is shown in the FIGS. 3-4, as noted. The mat 20 may be constructed according to many suitable constructions, but one construction comprises a rectangular "box" shape that is formed of a geotextile fabric 22 that may be constructed by circular knitting, flat knitting, weaving, non-woven formation or any other fabric construction having a multitude of openings through the thickness of the fabric 22. The fabric 22 is preferably seamed along its length and width to form the mat 20. The mat 20 may be constructed of a synthetic, biodegradable or natural material. The fabric 22 of the mat 20 may be constructed of any suitable natural or biodegradable/synthetic yarn, for example, a natural fiber such as cotton, hemp, ramie, jute or similar material because of its biodegradable characteristics, with apparent opening size (AOS) on the order of 0.25 to 0.5 mm depending on the size of the sphagnum peat or mushroom compost absorbent material. The empty mat 20 may be any suitable length, width and height, for example, 60 cm to 120 cm long, 30 cm to 60 cm long and 10 cm to 20 cm in height depending on the size of the grease trap and the FOG loading from the restaurant or vehicle oils from the vehicle repair facility. As manufactured, the mat 20 is preferably closed at one end and filled from the opposite, open end. The open end of the filled mat 20 may be closed with any suitable closure, such as stitching, clips, or snaps 24. The mat 20 may be seamed in such manner as to create individual compartments within the mat 20.

The mat 20 may include a loop 26 to receive a cord by which the mat 20 may be lowered into and retrieved from a grease trap or other enclosure and tethered to the grease trap or other structure while in use.

One or more coatings may be applied to the fabric 22 to prevent penetration of the fabric 22 surface by water or aqueous salts thereby allowing the fabric 22 substrate to be non-absorbent for water or soluble salts.

The preferable FOG absorbent material filled into the mat 20 is a specialized form of sphagnum peat "SP" or mushroom compost materials.

The following step by step process is expected for typical use and implementation of the FOG product and collection process. The process is explained with reference to the tube 10, but will be essentially the same when using the mat 20.

STEP 1: Introduce the tube 10 with selected sphagnum peat "SP" or mushroom compost into the grease trap or other FOG collection structure. Tether the tube 10 with cord 16 so that it stays at the influent end of the grease trap, and is the optimal location of FOG collection. Prior to placement in the grease trap, weigh the dry tube 10 so that a 'before and after" measure of FOG collection can be established.

STEP 2: After consultation with local water and sewer regulatory officials and the owner of the FOG collection device or grease trap, setup of a regular interval to remove and replace the FOG collection absorbent tube 10. From past experience, the best way to initiate the use of the FOG remediation technology is to start off as a regulatory approved Demonstration Project where the approach and results are measured and evaluated.

STEP 3: Depending on the interval for removal and collection of the FOG absorbent tube 10, arrange for storage in covered and secured FOG containers to avoid attracting small animals and rodents that are common in and around restaurants and vehicle repair facilities.

STEP 4: Transport the FOG tubes to an SSI facility. The FOG tube 10 is then part of waste to energy, renewable energy biofuel source.

The advantage of the FOG process using the tube 10 or mat 20 is that it safely and cost effectively separates FOG in the grease trap before it is mixed with large volumes of water and emulsified waste liquids. Separation after the fact is difficult and expensive.

The FOG absorbent tube 10 works for FOG collection because the sphagnum peat "SP" or mushroom compost materials are highly absorbent natural materials that separate the FOG from liquids or water. The absorbing characteristics are a combination of increased surface area and natural filtering processes, similar to that provided by charcoal or activated carbon. A slightly larger AOS in the filtering geotextile fabric 12 will allow more of the natural absorbing and geochemical attraction between the sphagnum peat "SP" to have better contact with the surface FOG materials to attract and collect it from the liquids/water. This approach reduces the tendency or emulsification of the FOG into the grease trap so that frequency of the grease trap pumping and remixing of the FOG and water/liquid will be reduced. Collecting the FOG from the surface of the grease trap is much more efficient and cost effective.

Estimate of the absorbing qualities of peat moss appear to be in the range of 5 to 10 kg/m$^2$ per FOG tube 10 per week.

This will be an area of applied research and measurement during future demonstration projects.

Polar molecules have a positive charge on one end and a negative charge on the other end. Non-polar molecules do not have two electrical poles and the electrons are distributed symmetrically on both sides. FOG is composed of organic non-polar compounds. Water is a polar solvent. Only polar compounds or other polar solvents will mix with water. Therefore, non-polar FOG will not readily mix with water. Depending on the source, FOG has a density of approximately 0.863-0.926 g/cm$^3$. Water has a density of approximately 1.000 g/cm$^3$. The lesser density substance will float on top of the greater density substance if it does not mix, thus non-polar FOG floats on water because it does not mix and gravity exerts more pull on the greater density water molecules. Water molecules are relatively small because they are only composed of one oxygen and two hydrogen molecules ($H^2O$). They, therefore, pack closely together in a space. Molecules of oil are large and have complicated shapes, thus requiring more space than water molecules. This is why oil is less dense than water.

A few oils having densities less than water are known to be polar compounds and can mix with water and therefore not float on the water's surface.

Thus, polarity and density both contribute to oil floating on water.

Polarity is a relative term. On a sliding scale, some oils are more or less polar than others, and have both polar and non-polar attributions. Also, the heating of oils and interaction with other organic compounds it is exposed to during heating, can change the oil's chemical composition, and thus change the relative polarity.

The above referenced principles permit the method of this application to work as intended and as developed.

Further evidence supporting the "charge" principle is found at Fat, Oil and Grease Science, Dothan, Ala. Fat, Oils, and Grease (FOG) Science https://www.dothan.org/DocumentCenter/View/3032/FOG---Science?bidId=

Testing of FOG as described above returned a B.T.U. value of 14,019 per pound using a method identified as ASTM D240. According to a preferred embodiment of the invention, the FOG product contains between 88-75 percent FOG and between 12 and 25 percent peat or mushroom solids as described above. Expected range of B.T.U. output is 12,500 to 15,500 B.T.U. per pound. The biofuel can be transported in its original container and subsequently compressed into a pellet, or log or other shape, shredded or granulated to increase its surface area and render it more easily combustible.

Motor vehicle oils similarly incorporated into the FOG product can produce in the range of 20,000 B.T.U. per pound.

If the FOG is originally collected in a synthetic container, transferring the FOG into some form of container of natural materials, as described above, means that the entire product, FOG, capture material and container can be used as fuel. As is apparent from the above discussion, the FOG/capture material product can be removed from its formation container for being compressed into a pellet, log, cake or other shape, shredded or granulated, or may remain in its formation container for being combusted, as illustrated in FIG. 5.

A biofuel product having fat, oil and/or grease components according to the invention has been described with reference to specific embodiments and examples. Various details of the invention may be changed without departing from the scope of the invention. Furthermore, the foregoing description of the preferred embodiments of the invention and best mode for practicing the invention are provided for the purpose of illustration only and not for the purpose of limitation, the invention being defined by the claims.

I claim:

1. A biofuel product comprising:

(a) A container formed of a biodegradable geotextile having a multiplicity of openings having an apparent opening size (AOS) of 0.25 mm to 0.5 mm and adapted for allowing fat, oil and/or grease components to pass through the openings to an interior area of the container;

(b) An absorbent capture material positioned in the container comprising a quantity of a fat, oil and/or grease, the container capture material and fat, oil and/or grease therein collectively comprising the biofuel product;

(c) the fat, oil and/or grease absorbent capture material selected from the group consisting of sphagnum peat and mushroom compost;

(d) the fat, oil and/or grease present in a range of between 88-75 percent and the capture material present in a range of between 12 and 25 percent;

(e) the fat, oil and/or grease and the absorbent capture material being in a form selected from the group of forms consisting of compressed pellets, logs, cakes, shredded and granulated.

2. The biofuel product according to claim 1, wherein the range of B.T.U. output of the biofuel product is 12,500 to 20,000 B.T.U. per pound.

3. The biofuel product according to claim 2, wherein the container is a tube.

4. The biofuel product according to claim 3, wherein the container is a three dimensional box-like mat.

5. The biofuel product according to claim 1 wherein the biodegradable geotextile is constructed of a biodegradable yarn selected from the group consisting of cotton, hemp, ramie and jute.

6. The biofuel product according to claim 1, wherein the container includes a tether for positioning the container at an influent end of a source of fat, oil and/or grease during absorption of the fat, oil and/or grease into the capture material.

7. The biofuel product according to claim 1, wherein the container includes one closed end and an open end after being filled with the capture material.

8. The biofuel product according to claim 1 wherein the container includes two closed ends after being filled with the capture material.

* * * * *